United States Patent [19]

Christianson et al.

[11] Patent Number: 4,705,449

[45] Date of Patent: Nov. 10, 1987

[54] SKID-STEER VEHICLE

[76] Inventors: Leslie L. Christianson, Rte. 3, Box 118; Ralph Alcock, 127 Jefferson Ave. South; Donell P. Froehlich, 2120 Derdall Dr., all of Brookings, S. Dak. 57006; Kellen J. Chicoine, R.R. 1, Box 248, Elk Point, S. Dak. 57025

[21] Appl. No.: 33,903

[22] Filed: Mar. 30, 1987

Related U.S. Application Data

[63] Continuation of Ser. No. 753,300, Jul. 10, 1985, abandoned.

[51] Int. Cl.[4] ..... B66F 9/00

[52] U.S. Cl. ..... 414/68.5; 180/6.5; 414/914; D15/25; D15/30

[58] Field of Search ..... 414/685, 697, 914; 180/6.5; D15/25, 30, 32

[56] References Cited

U.S. PATENT DOCUMENTS

| | | | |
|---|---|---|---|
| Des. 195,254 | 5/1963 | Keller et al. | D14/3 |
| 2,482,612 | 9/1949 | Drott et al. | 214/140 |
| 2,506,242 | 5/1950 | Shoemaker | 414/914 |
| 2,798,565 | 7/1957 | Rosenthal et al. | 180/6.5 |
| 2,821,313 | 1/1958 | Warner | 214/140 |
| 2,833,360 | 5/1958 | Spanjer | 180/6.48 |
| 2,980,271 | 4/1961 | Ulinski | 214/140 |
| 3,131,493 | 5/1964 | LeTourneau | 37/124 |
| 3,151,503 | 10/1964 | Keller et al. | 74/722 |
| 3,231,117 | 1/1966 | Melroe et al. | 214/140 |
| 3,288,316 | 11/1966 | West | 214/771 |
| 3,489,238 | 1/1970 | Kruckman | 180/105 |
| 3,722,724 | 3/1973 | Blakely | 214/776 |
| 3,767,075 | 10/1973 | Leverenz | 214/776 |
| 3,794,191 | 2/1974 | Kuhn | 214/774 |
| 3,800,969 | 4/1974 | Steiger | 414/697 |
| 3,937,339 | 2/1976 | Geis et al. | 414/697 |
| 3,963,131 | 6/1976 | Dimmer | 414/697 |
| 3,995,761 | 12/1976 | Hurlburt | 214/776 |
| 4,257,732 | 3/1981 | Staffanson | 414/703 |
| 4,405,280 | 9/1983 | Cochran et al. | 414/685 |
| 4,415,049 | 11/1983 | Wereb | 180/6.5 |
| 4,547,118 | 10/1985 | Pittenger | 414/685 |
| 4,562,893 | 1/1986 | Cunard | 180/6.5 |

FOREIGN PATENT DOCUMENTS

| | | | |
|---|---|---|---|
| 2261306 | 8/1973 | Fed. Rep. of Germany | 414/685 |

*Primary Examiner*—Joseph E. Valenza
*Attorney, Agent, or Firm*—Kinney & Lange

[57] ABSTRACT

A skid-steer vehicle has a housing defining a driver's compartment and a loader arm that permits the driver to enter and leave the vehicle through left and right side access openings. The arm is constructed to eliminate the hazardous condition of entering from the front of the vehicle or from a side where the loader arm crosses the access space. The housing includes first and second spaced apart support frames. Each support frame includes a forward and a rearward upwardly extending member joined at an upper portion by a connecting member. The forward, rearward and connecting members, define a side access opening to the driver's compartment. The loader arm has a rearward portion which is pivotally attached to the rearward members of the support frames and a forward portion and a middle portion connecting the forward and rearward portions such that when the loader arm is either in an up position or a down position, the loader arm does not extend into the access openings.

4 Claims, 6 Drawing Figures

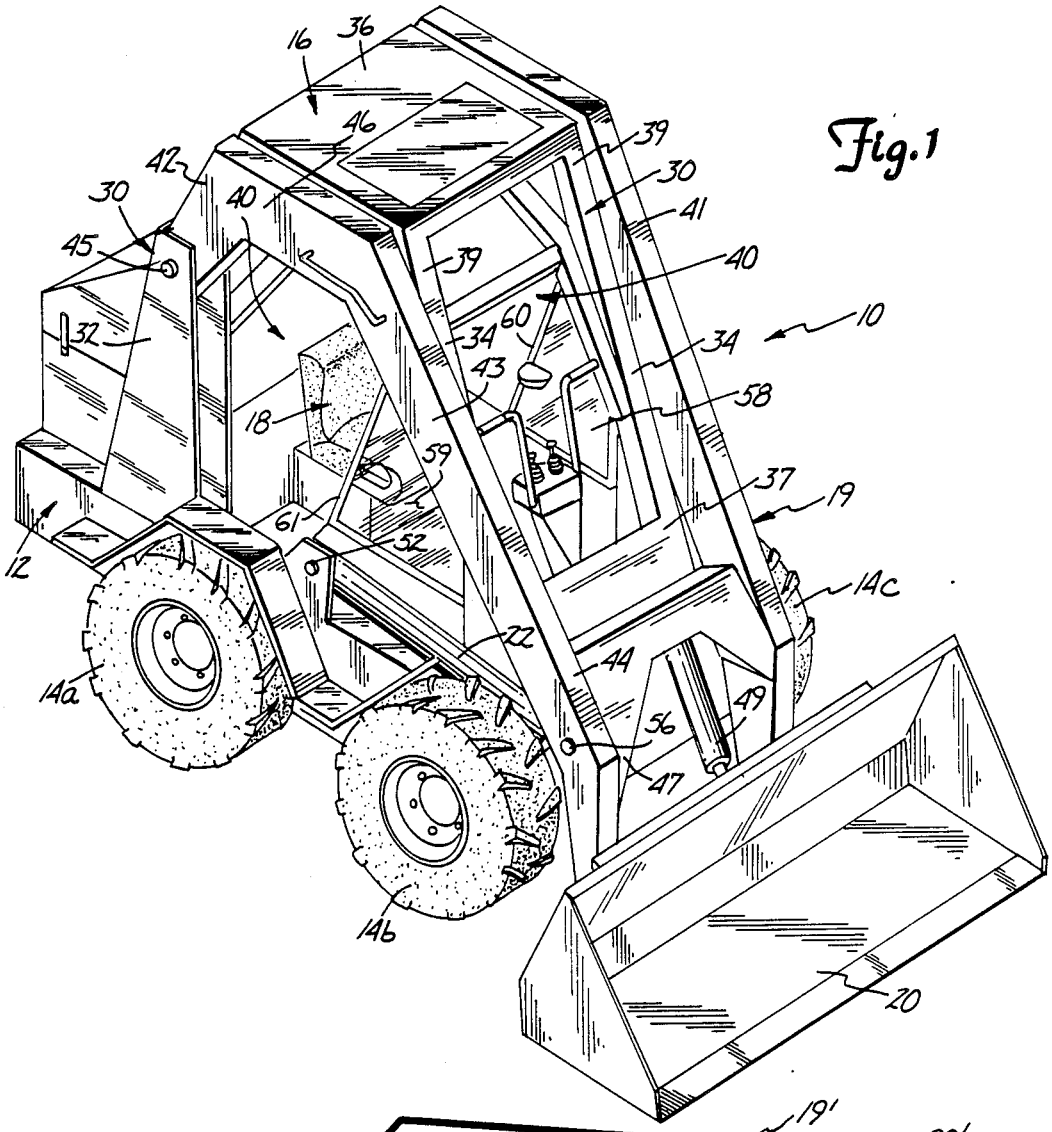
Fig. 1
Fig. 4
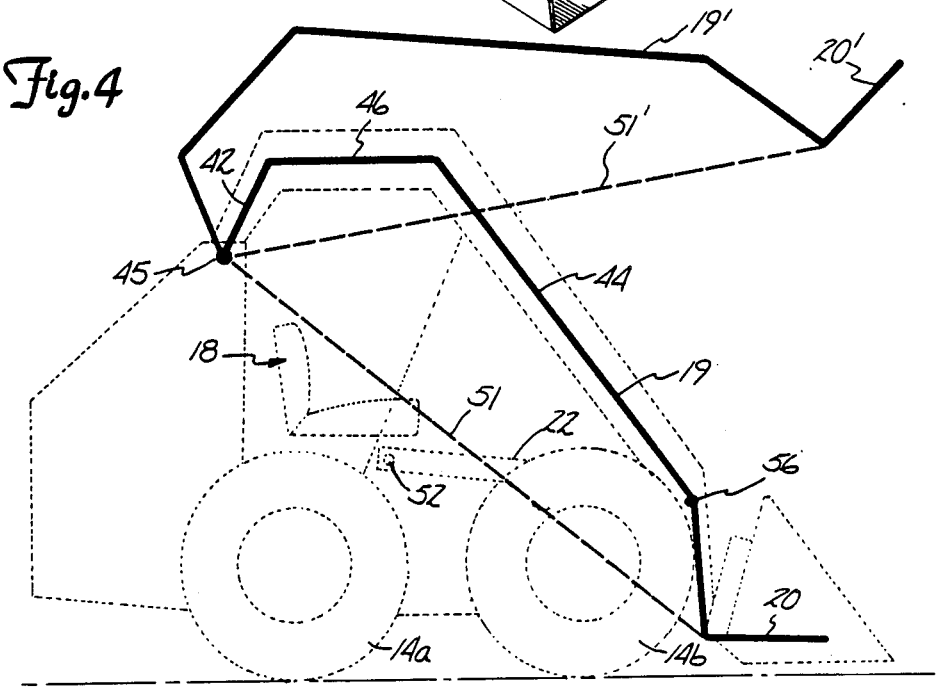

SKID-STEER VEHICLE

REFERENCE TO CO-PENDING APPLICATION

This application is a continuation of pending application Ser. No. 06/753,300 filed July 10, 1985, abandoned as of the filing date of the present application.

BACKGROUND OF THE INVENTION

1. Field of the Invention.

The present invention is directed to skid-steer vehicles, and in particular, it is directed to a skid-steer vehicle having a side entry to the driver's compartment.

2. Description of the Prior Art.

Skid steer-type vehicles with pivotal loading arms that are hydraulically actuated have been known for quite some time and have been quite commercially successful. The following prior art patents describe various skid-steer vehicles.

| Inventor | U.S. Pat. No. |
|---|---|
| Blakely | 3,722,724 |
| Leverenz | 3,767,075 |
| Kuhn | 3,794,191 |
| Hulburt | 3,995,761 |
| Melroe et al | 3,231,117 |
| Keller et al | Des. 195,254 |
| Cochran et al | 4,405,280 |

The above-mentioned prior art patents describe skid-steer vehicles which are entered by the operator at the front of the vehicle, either over the bucket when the bucket is lowered or underneath the bucket when the bucket is in a raised position. Both are potentially dangerous situations. Entry over the arms that raise the bucket is also hazardous and difficult.

The Drott et al U.S. Pat. No. 2,482,612 and the Warner U.S. Pat. No. 2,821,313 show crawler-type vehicles with loader arms that are moved by rearwardly disposed hydraulic cylinders. The crawler vehicles have driver compartments which are entered from the rear having to cross over the back of the seat.

Other patents such as the West U.S. Pat. No. 3,288,316, the Ulinski U.S. Pat. No. 2,980,271, and the Keller et al U.S. Pat. No. 3,151,503 describe other types of loading vehicles having pivotally mounted loading arms that are moved by hydraulic cylinders. However, none of the vehicles described in the immediately above-mentioned patents provide an unobstructed safe side entry access to the driver's compartment.

SUMMARY OF THE INVENTION

The present invention includes a skid-steer vehicle having a housing that defines a driver's compartment and a loader arm that permits the driver to enter and leave the vehicle through side entries in the housing. The housing includes first and second spaced-apart support frames that are positioned on opposite sides of the driver's compartment. The support frames include a forward and a rearward upwardly extending member joined at an upper portion by a connecting member. The forward, rearward and connecting members define side access openings to the driver's compartment. The loader arm has a rearward portion which is pivotally attached to the rearward members of the support frames and a forward portion and a middle portion connecting the forward and rearward portions such that when the loader arm is either in an up position or a down position, the loader arm does not extend into the access openings.

Preferably, the skid-steer vehicle is electrically powered including a first electric motor to drive the wheels located on one side of the vehicle and a second electric motor to drive the wheels located on another side of the vehicle and a portable electric power source, such as a battery, preferably located on a rearward portion of the vehicle to provide power to the electric motors.

BRIEF DESCRIPTION OF THE DRAWINGS

FIG. 1 is a perspective view of the skid-steer vehicle of the present invention.

FIG. 4 is a diagrammatical view comparing a straight line loader arm of the prior art to the loader arm of the present invention.

DETAILED DESCRIPTION OF THE PREFERRED EMBODIMENTS

Figure 2:
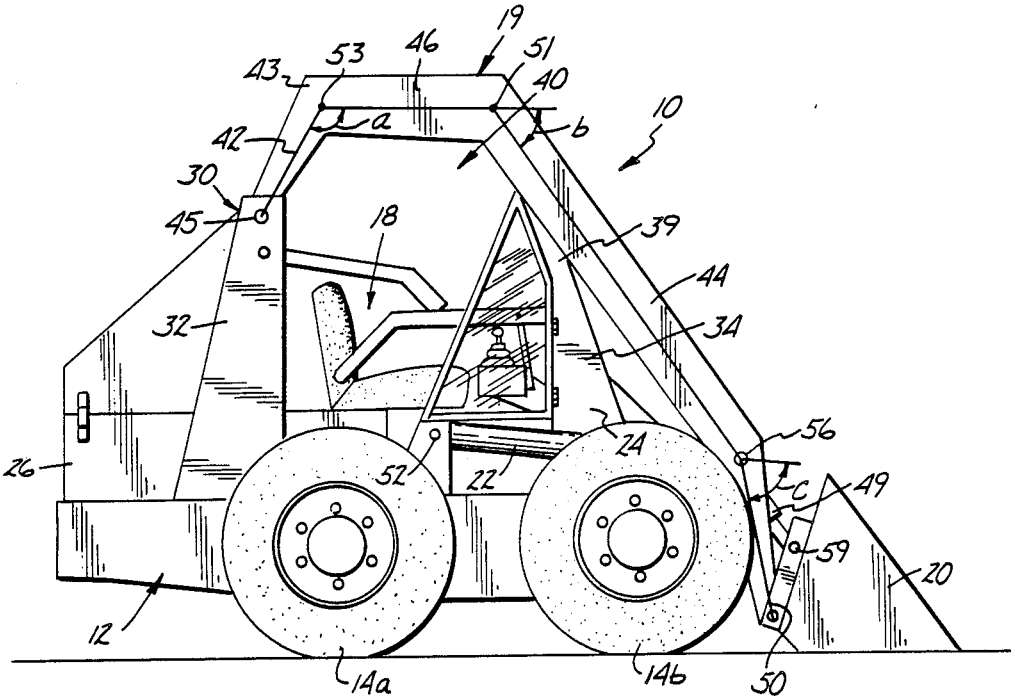
FIG. 2 is a side elevational view of the skid-steer vehicle with the loader arm in a down position.
Figure 3:
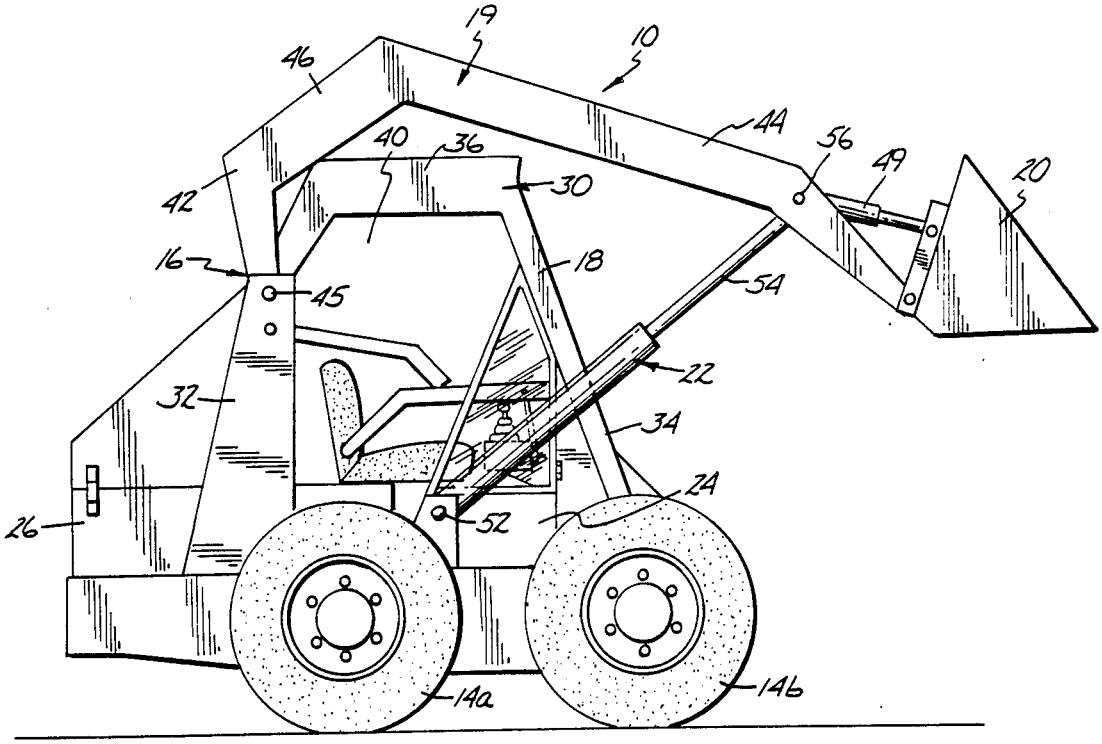
FIG. 3 is a side elevational view of the skid-steer vehicle with the loader arm in a raised position.

The skid-steer vehicle of the present invention is generally indicated at 10 in FIGS. 1–3. The skid-steer vehicle 10 includes a main body portion 12 having rotatably attached wheels 14*a* through 14*d* (with wheel 14*d* being shown in FIG. 3) for over-the-ground travel. The skid-steer vehicle further includes a housing 16 fixed to the main body 12 and a loader arm 19 defining a driver's compartment generally indicated at 18. The loader arm 19 is pivotally attached to the housing 16 at one end and has a bucket 20 operably attached to an opposite end. Left and right double-action hydraulic cylinders 22 (left cylinder not shown) provide force to raise and lower the loader arm 16.

The body 12 is generally longitudinal having a forward portion 24 and a rearward portion 26 containing a battery pack (not shown in FIGS. 1 and 2) for providing power to the device 10. The battery pack includes several industrial grade lead-acid batteries and provides power to the vehicle. The battery pack is located at the rearward portion of the body 12 to serve as a ballast to help offset any load being carried by the vehicle.

The housing 16 includes left and right support frames 30. Each support frame 30 includes a rearward support member portion 32, a forward support member portion 34 and a connecting roof portion 36. The rearward support member portions are attached to the body at a lower end, such as by welding, and extend generally upwardly toward the roof portion 36. Each forward support member portion 34 is also fixedly attached to the body 12 at a lower portion preferably by a lower connecting member 37, such as by welding. Each forward support member extends in a generally upward direction and has an upper section 39 inclined toward the back of the vehicle 10.

The connecting roof portion 36 is connected to both the rearward member portions 32 and the forward member portions 34 to form the housing 16. The housing 16 and the loader arm 19 define left and right access openings 40 on both sides of the vehicle providing easy and safe entry into the driver's compartment 18.

The loader arm 19 includes left and right arm sections 41 and 43. Each arm section has a rearward portion 42, a forward portion 44 and a midportion 46. The arm sections 41 and 43 are disposed on the left and right sides of the housing 16 and are pivotally attached to the rearward support members 32 at pivot points 45 (left pivot point not shown). The arm sections 41 and 43 are attached to each other at the forward portions 44 by a transversely disposed connecting member 47.

Referring to FIG. 4, a straight line loader arm of the prior art and the loader arm of the present invention is compared diagrammatically. The loader arm of the present invention is indicated by 19 in the lowered position and by 19' in the raised position. The straight line loader arm of the prior art is indicated by 51 in the lowered position and by 51' in the raised position (both in heavy broken lines). As illustrated in FIG. 4, the straight line loader arm 51 obstructs entry into the driver's compartment 18 in the lowered position as well as in the raised position and any position in between. In addition, a lift cylinder would have to be mounted at a point rearward of the driver's compartment 18 in order to provide a lift cylinder sufficiently long to adequately lift the lift arm.

The loader arm of the present invention permits side entry into the driver's compartment 18 with sections 42, 44 and 46 forming an arch that is generally aligned with the configuration of the housing when in the lowered position. The loader arm does not obstruct access into the driver's compartment when in the lowered and raised position or any position in between. In addition, the lift cylinder 22 is pivotally attached forward of the driver's compartment to the frame of the skid-steer vehicle at point 52 and pivotally to the loader arm at point 56. The arched section of the loader arm permits the pivot point 52 to be placed at a point forward of the entry to the driver'compartment resulting in the distance between the pivot points 52 and 56 being sufficient to permit a cylinder of sufficient length so that the loader arm 19 can be raised to an adequate height.

Referring to FIG. 2, the angles formed by the loader arm portions and the lengths of the loader arm portions of one working embodiment of the present invention are illustrated. The distance between the pivot point 45 and a point 53 about which angle a is formed is approximately fifteen inches (15") which is approximately the length of portion 42. The distance from a lower pivot point 50 pivotally connecting the bucket 20 to the loader arm to the pivot point 56 is approximately twenty-two inches (22"). The distance (along the axis of portion 44) from the pivot point 56 to a point 51 about which angle b is formed is approximately fifty-nine inches (59") and from point 51 to the point 53 the distance is approximately twenty-five inches (25"). Angle b which is the angle formed between the axis of portion 46 and the axis of portion 44 is approximately 51°. Angle a which is the angle formed by the axis of portion 46 with the axis of portion 42 is approximately 113°. The angle formed between a line running from pivot point 56 to pivot point 50 and the axis of the hydraulic cylinder 22 is the down position, angle c, is approximately 82°. The hydraulic cylinder 22 is movable approximately 63° from the down position to a position wherein the loader arm is fully raised.

The driver's compartment 18 is defined at a forward end by left and right glass panels 58 and 59 which extend from forwardly inclined posts 60 and 61, respectively, forward to support member portions 34. The posts 60 and 61 define the forward boundary of the entryway 40.

The bucket 20 is connected to the loader arm 19 at pivot point 50 and is pivotal about pivot point 50. A hydraulic cylinder 49 pivotally attached to the member 47 at one end and pivotally attached at pivot point 59 pivots the bucket 20 with respect to the loader arm. The hydraulic cylinder is operated through the same hydraulic system (not shown) as is hydraulic cylinder 22.

Figure 5:
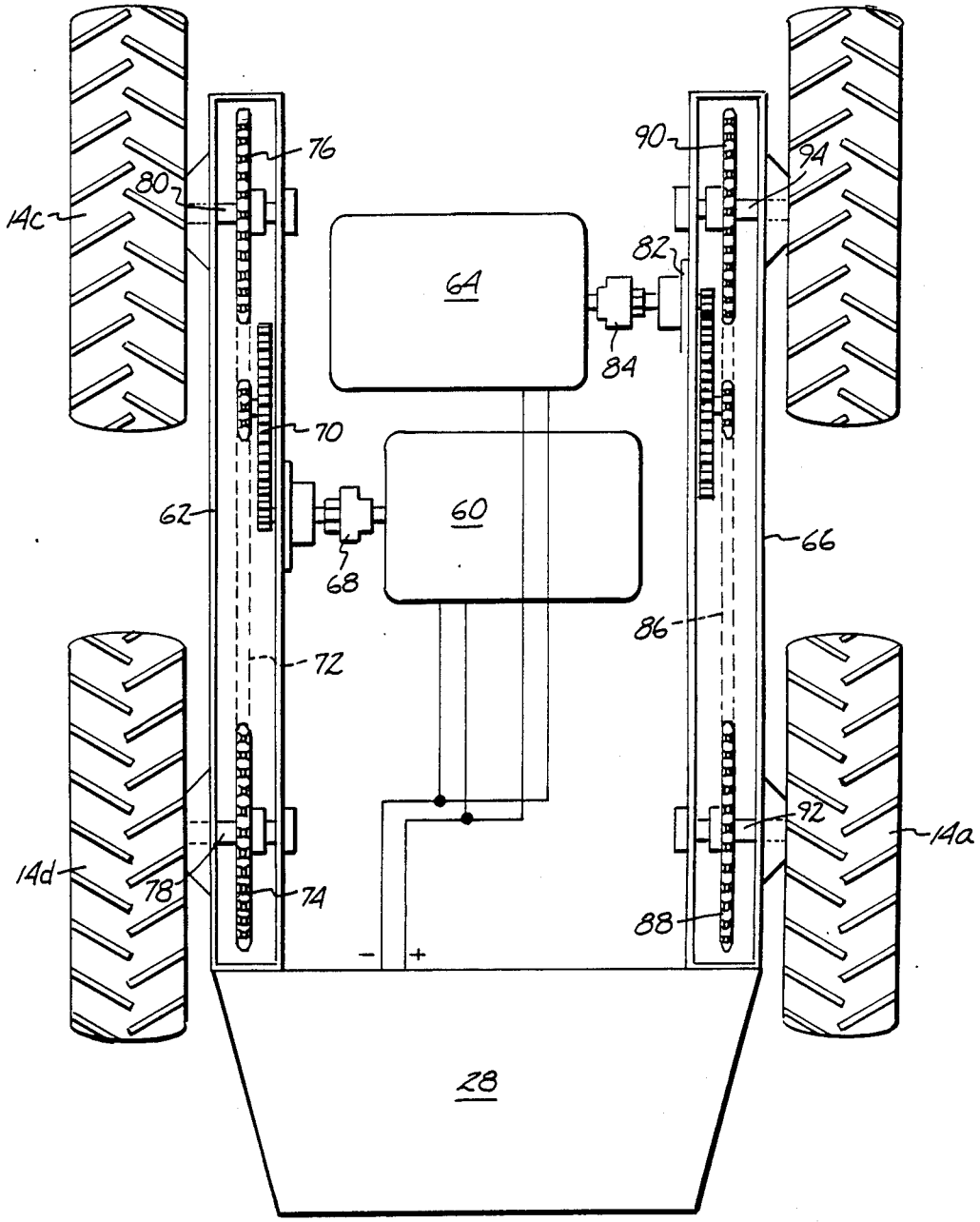
FIG. 5 is a plan view of the drive train of the skid-steer vehicle.

Referring to FIG. 5, which illustrates a plan view of the vehicle of the present invention, a first traction motor 60 provides the motive force for the left-hand side 62 of the vehicle and a second traction motor 64 provides the motive force for a right-hand side of the vehicle 66. Both the first traction motor 60 and the second traction motor 64 are powered by a battery pack 28. A suitable traction motor is made by General Electric Company.

The traction motor 60 is coupled by a coupling 68 to a spur gear reduction assembly 70 that engages a chain 72. The chain 72 in turn engages left rearward gear 74 and left forward gear 76 which are in turn respectively connected to wheels **14*d* and 14*c* through axles 78 and 80**.

Similarly, the traction motor 64 is connected to a spur gear reduction assembly 82 through a coupling 84. The spur gear reduction assembly 82 engages a chain 86 which in turn engages a right rearward gear 88 and a right forward gear 90, which are respectively connected to wheels **14*a* and 14*b* through axles 92 and 94. As will be appreciated, the traction motor 60 is operated independently of the traction motor 64 thereby permitting the wheels 14*c*, 14*d* to operate at a different speed than wheels 14*a* and 14*b*** to create the skid-steering. The electrical system of the present invention provides a simplified method of imparting different speeds to different sides of the vehicle.

Figure 6:
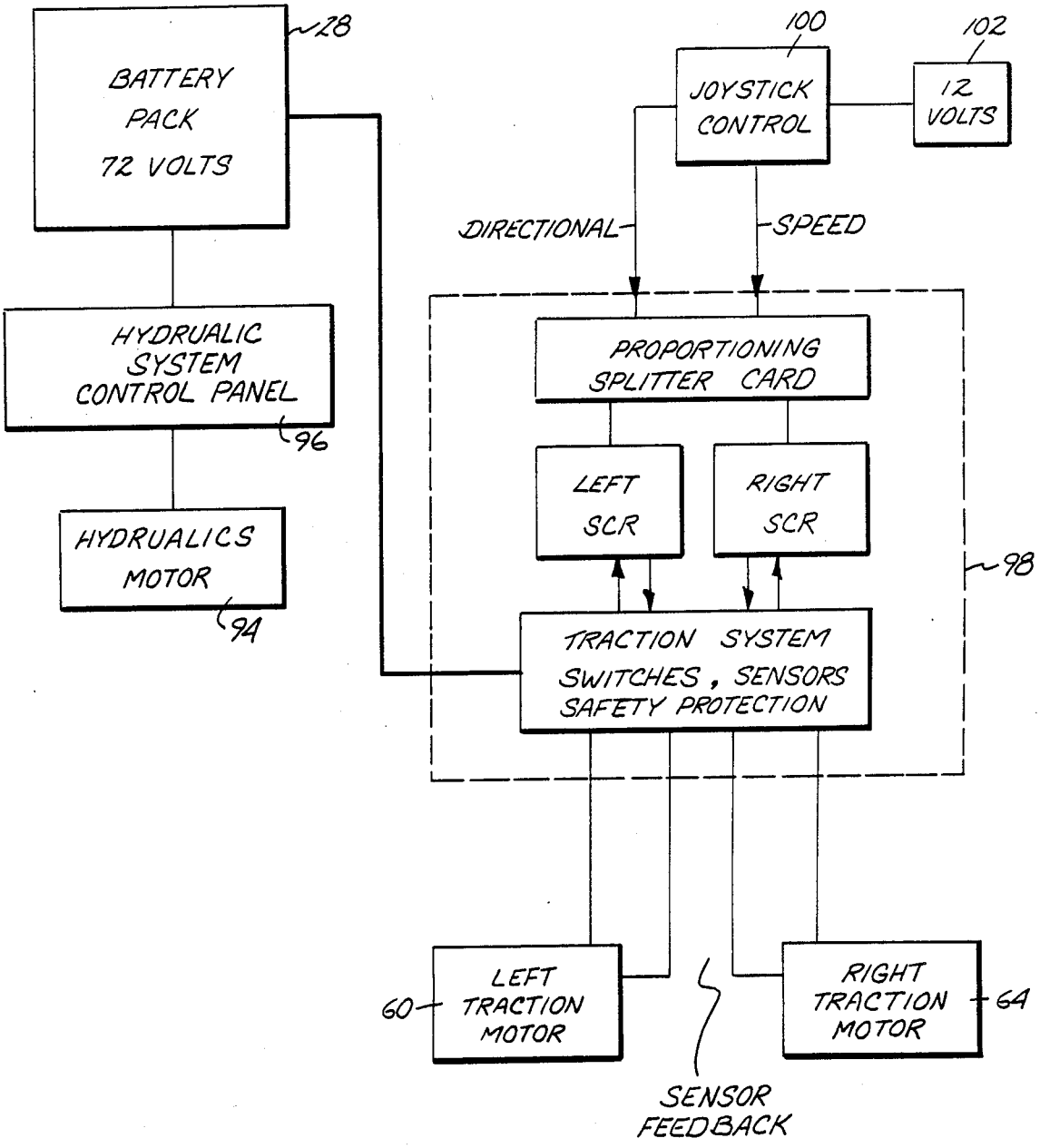
FIG. 6 is a diagrammatical view of the electrical system.

A block diagram of the electrical system of the vehicle of the present invention is illustrated in FIG. 6. The battery pack 28 is the power source for the hydraulic system to run the hydraulic cylinders that move the loading arm and the bucket and is the power source to run the traction motors that drive the vehicle.

The battery pack provides power to the hydraulic motor 94 through a hydraulic system control panel. Hydraulic fluid is delivered under pressure in a well known manner to the hydraulic cylinders 22 and 49.

From the battery pack 28, power is also delivered to a dual proportioning controller 98. A suitable dual proportioning controller is sold under the trademark "EV-1 SCR CONTROL" by General Electric Company. The dual proportioning controller is operated by a joy stick control 100. Power is supplied to the joy stick control 100 by a 12-volt source 102 which is preferably supplied by power from the battery pack 28 using a voltage reduction device (not shown). The joy stick control 100 provides both directional and speed control through the proportioning controller 98 such that the left traction motor is operated at a different speed than the right traction motor to steer the vehicle and such that both left and right traction motors are also operable at the same speed to move the vehicle forward and backward.

Although the present invention has been described with reference to preferred embodiments, workers skilled in the art will recognize that changes may be made in form and detail without departing from the spirit and scope of the invention.

What is claimed is:

1. A skid-steer vehicle comprising:

a body having a right and a left side and a front and a rear pair of ground-engaging wheels with two of the wheels rotatably mounted along the left side and two of the wheels rotatably mounted along the right side;

means for operating the wheels on the left side at a different speed than the wheels on the right side to create a skid-steering movement;

a housing including first and second spaced apart support members each support member having a forward and a rearward upwardly extending member joined to each other at an upper end portion by a connecting member such that the housing defines a driver's compartment and the first and second support members defining first and second side access openings with the driver's compartment being located substantially between the front and rear wheels;

a loader arm having a downwardly extending rearward portion, a forward portion and a middle portion, the rearward portion being pivotally attached to the rearward member of the support member rearward of the access openings at an upper portion of the rearward member and wherein the loader arm, when either in an up position or a down position, does not extend into the access openings;

hydraulic cylinder means for raising and lowering the loader arm and wherein the hydraulic cylinder means is pivotally attached to the body at a position forward of the access opening at one end and attached to the loader arm at another end such that when the loader arm is either in the up or the down position, the hydraulic cylinder means does not interfere with the access openings; and wherein the first and second spaced-apart support members and the connecting member of the housing define an arched upper portion of the access opening and the rearward portion, forward portion, and middle portion of the loader arm are in general alignment with the arched portion of the housing when the loader arm is in the down position.

2. The skid-steer vehicle of claim 1 including a portable electric power source mounted on the body rearward of the driver's compartment and the rear wheels and first and second electric motors powered by the portable electric power source and first means for transmitting power from the first electric motor to the ground-engaging wheels on one side of the vehicle and second means for transmitting power fro the electric motor to the ground-engaging wheels on the other side of the vehicle and means for controlling electric power to the motor such that the speed of the ground-engaging wheels on one side of the vehicle are operable separately from the speed of the ground-engaging wheels on the other side of the vehicle.

3. The vehicle of claim 2 and including a hydraulic motor and control means for controlling power from the portable electric supply to the hydraulic motor to operate the hydraulic cylinder means.

4. A skid-steer vehicle comprising:

a frame having a left side and a right side and a front end portion and a rearward end portion and including first and second spaced-apart support members, each support member having a forward and a rearward upwardly extending member joined to each other at an upper end portion by a connecting member such that the frame defines a driver's compartment and the first and second support members define first and second side access openings;

front and rear pairs of ground-engaging wheels supporting the frame for over-the-ground travel with two wheels rotatably attached to the left side of the frame and two wheels rotatably attached to the right side of the frame;

first electric motor means drivably connected to the wheels attached to the left side of the frame;

second electric motor means drivably connected to the third and fourth wheels attached to the right side of the frame;

a portable battery means for supplying electrical power to the first and second electric motor means and located on a rearward portion of the frame rearward of the rear wheels;

control means for selectively controlling the speed of the first and second motor means such that the speed of the first and second wheels are operable independently of the speed of the third and fourth wheels in such a manner as to cause forward and rearward movement and to provide steering based on speed differential between the first and second wheels and the third and fourth wheels;

a loader arm having a downwardly-extending rearward portion, a middle portion and a forward portion, the loader arm being pivotally attached to the rearward portion at a position rearward of the access openings and at an upper portion of the rearward member;

hydraulic cylinder means pivotally attached at one end to the frame and at another end to the loader arm for raising and lowering the loader arm; and hydraulic means for selectively supplying hydraulic fluid to the hydraulic cylinder means under pressure and including a hydraulic pump means electrically powered by the battery means for placing the hydraulic fluid under pressure.

* * * * *